US008245889B1

(12) United States Patent
Starns

(10) Patent No.: US 8,245,889 B1
(45) Date of Patent: Aug. 21, 2012

(54) PORTABLE PUMPLESS FUEL DELIVERY SYSTEM

(76) Inventor: Jon Starns, Winona, KS (US)

( * ) Notice: Subject to any disclaimer, the term of this patent is extended or adjusted under 35 U.S.C. 154(b) by 492 days.

(21) Appl. No.: 12/590,126

(22) Filed: Nov. 3, 2009

(51) Int. Cl.
*B67D 7/04* (2010.01)

(52) U.S. Cl. ..... 222/399; 222/464.1; 222/481.5; 222/482; 222/527

(58) Field of Classification Search ..... 222/399, 222/400.7, 464.1, 394, 396, 481.5, 482, 527, 222/529; 137/209, 206; 141/21, 25
See application file for complete search history.

(56) References Cited

U.S. PATENT DOCUMENTS 4,785,973 A * 11/1988 Kobe ..... 222/82
4,994,180 A * 2/1991 Sims et al. ..... 210/198.2
5,447,142 A 9/1995 Bailey
5,476,154 A * 12/1995 Sage ..... 184/1.5
5,526,795 A 6/1996 Thompson
5,570,813 A * 11/1996 Clark, II ..... 222/1
6,167,908 B1 * 1/2001 Rottger ..... 137/614.17
6,453,877 B1 9/2002 Lucier
6,640,842 B1 * 11/2003 Laukenmann et al. ..... 141/2
6,898,374 B1 5/2005 Wen
7,152,635 B2 12/2006 Moravec
7,395,832 B2 7/2008 Behruzi
7,467,623 B2 12/2008 Turner
8,091,378 B1 * 1/2012 Farias et al. ..... 62/389
2004/0163731 A1 8/2004 Eichelberger
2009/0090724 A1 4/2009 Childress
2012/0048888 A1 * 3/2012 Pizzacella et al. ..... 222/144.5

* cited by examiner

*Primary Examiner* — Kevin P Shaver
*Assistant Examiner* — Donnell Long
(74) *Attorney, Agent, or Firm* — Randal D. Homburg

(57) ABSTRACT

The fuel delivery system is assembled from a large capacity refillable fuel tank and a refillable pressurized compressed gas or air tank to provide a portable fuel supply system to deliver fuel to a variety of different vehicles and equipment without requiring the use of a manual or powered fuel pump within the system, providing the fuel delivery system without any need for a powered source to dispense fuel from the fuel tank, the compressed gas tank providing a positive pressure within the fuel tank to dispense the fuel from the fuel tank.

5 Claims, 4 Drawing Sheets

PORTABLE PUMPLESS FUEL DELIVERY SYSTEM

CROSS REFERENCE TO RELATED APPLICATIONS

None.

I. BACKGROUND OF THE INVENTION

1. Field of Invention

The fuel delivery system is assembled from a large capacity refillable fuel tank and a refillable pressurized compressed gas or air tank to provide a portable fuel supply system to deliver fuel to a variety of different vehicles and equipment without requiring the use of a manual or powered fuel pump within the system, providing the fuel delivery system without any need for a powered source to dispense fuel from the fuel tank, the compressed gas tank providing a positive pressure within the fuel tank to dispense the fuel from the fuel tank.

2. Description of Prior Art

A preliminary review of prior art patents was conducted by the applicant which reveal prior art patents in a similar field or having similar use. However, the prior art inventions do not disclose the same or similar elements as the present portable pumpless fuel delivery system, nor do they present the material components in a manner contemplated or anticipated in the prior art.

In patent Application No. 2009/009074 to Childress, published on Apr. 9, 2009, a fuel tank assembly discloses a fuel tank to limit an amount of damage caused by a ballistic projectile, which includes an exterior wall and an inner fuel bladder wall defining a fuel storage area. Between the exterior wall and the inner fuel bladder wall lies a bladder, with the exterior wall being more rigid than the inner fuel bladder wall. Connectors allow for an introduction of a pressurized gas to create a space within the bladder. The fuel tank assembly also includes a valve through the inner bladder wall to permit at least some of the pressurized gas to be introduced into the fuel within the inner bladder wall.

In U.S. Pat. No. 6,786,245 to Eichelberger, a self contained mobile fuel station does not use mechanical compression, external electric power or other external utilities. This station provides first and second vessels, a conduit in fluid communication with the receiving tank and each of the first and second vessels, a means for transferring at least a portion of the quantity of the pressurized fluid from the verst vessel to the receiving tank, a means for measuring the pressure differential between the receiving tank and the decreasing pressure within the first vessel, a cutoff means to close off the pressure from the first vessel when a certain limit is attained, and a means for transferring at least a portion of a quantity from the pressurized fluid from the second vessel to the receiving tank. This station still requires the use of an on-board electrical supply to operate the complex necessary electronics used to control the operation of the station. Its stated fuel usage is compressed hydrogen gas and does not indicate any use for liquid fuel delivery, although there is an indefinite term used in part for the receiving tank being a vehicle fuel storage tank. It also discloses an automated delivery system for the delivery of a pressurized hydrogen gas, along with the product patent in the earlier claims.

A fuel system obtaining pressurized gas from an internal combustion engine to perpetuate the flow of fuel, is demonstrated in U.S. Pat. No. 5,447,142 to Bailey. A fuel delivery system including a purge device which includes a compressor including a tank for supplying compressed air to a line connected to a fuel line between a fuel tank and a pump to push fuel back into a tank is shown in U.S. Pat. No. 7,467,623 to Turner. Some patents for fuel delivery systems require an electric pump to deliver the fuel to an internal combustion engine, as indicated in U.S. Pat. Nos. 6,453,877 to Lucier and 6,898,374 to Wen.

The present device has no pump, derives no power from any external or internal power source, other than compressed gas or air stored in a tank, and has no working component which would clog of fail during repeated normal operation. It is intended for the delivery of liquid fuels and has no operational electrical or electronic components. It may be provided on any portable delivery platform and does not require any engine for its operation or function. It is simply filled with a liquid fuel and a compressed gas or air, and manual valves and delivery hoses function to provide fuel to any vehicle or equipment using the fuel, regardless of temperature or weather and without using any exhaust air from a combustion engine.

II. SUMMARY OF THE INVENTION

Industry and agriculture often have several vehicles and numerous items of equipment which require delivery of a fuel supply in the filed of operation. It is often more efficient to delivery fuel to the vehicle or equipment in the field than to require the vehicle or equipment to return to a stationary fuel supply depot, which would result in a loss of time and the additional expense incurred in traveling to a stationary fuel supply depot.

It is known in the art of fuel delivery to provide a portable fuel delivery system to transport and deliver fuel to various locations for several fuel consuming vehicles and equipment. For example, the operation of a farm generally includes several tractors, combines, trucks, and other farm equipment which will operate on a common fuel—most often diesel fuel or gasoline. More prudent farmers will attempt to operate all or most of their vehicles and equipment on a common fuel. As further example, during a farming operation involving the harvest of crops, a combine or harvester is operating nearly twenty-fours hours a day to complete the harvest, plus transporting the crops to the grain elevators in trucks or trailers, and generally operating tractors to either bale the byproducts or to work the soil for the planting of the next crop. Most of these vehicles and equipment are consuming fuel contemporaneously, which would best be served by a portable fuel supply in the field to fill each vehicle and piece of equipment without a significant loss of time or labor.

The prior art portable fuel supply systems will provided a pump as part of the delivery system, with power either supplied on-board or derived from the vehicle towing the fuel supply system. Fuel pumps and known to be a common source of failure or breakdown due to clogging or simply ceasing operation. If the pump fails, there is no fuel delivery and time and downtime are required to place the fuel delivery system back into an operational mode. Additionally, where the fuel delivery system derives its power source from the towing vehicle, a significant drain on the towing vehicle power supply is realized and a fuel delivery system has been known to completely drain the towing vehicle battery in a matter of a few hours, leaving the towing vehicle and the fuel delivery system stranded in the field.

The present fuel delivery system is a portable system, either being operated from a trailer or installed in the bed of the supply vehicle or truck. It is a simply system which has no pump and requires no external power supply to operate the fuel delivery system. The system requires only a fuel tank, a compressed gas or air tank, and the connective tubing required to fill the fuel tank, provide compressed gas or air from the compressed gas or air tank to the fuel tank, check valves to prevent fuel from entering the gas or air tank, and a delivery hose with a dispensing hose to provide fuel from the fuel tank under pressure to the vehicle or equipment to which the fuel is delivered. The fuel tank is filled at a stationary fuel supply location, and the compressed gas or air tank is filled to capacity where the compressed gas or air is available. Once charged with compressed gas or air to capacity and also once the fuel tank is full of fuel, the present system may be taken from one location to another to fill vehicles and equipment several times without requiring and power source other than transportation, and also without encountering a clog within any pumps or any pump failure.

The primary objective of the invention is to provide a fuel delivery system which has no pump. Second, it is an objective to provide the fuel delivery system requiring no power source to dispense the fuel. A third objective is to provide the fuel delivery system with a reduced potential for system failure as would be encountered with a fuel delivery system which had a pump, required an external power supply to conduct its operation and was comprised of components which could be come clogged from the environment or from contaminants which might be introduced into a system from the environment in which the fuel delivery system is used. In addition, the system by operating without any external power supply will also reduce the potential of an accidental ignition of the fuel supply by an operational component, as would be found in other fuel delivery systems.

III. DESCRIPTION OF THE DRAWINGS

The following drawings are submitted with this utility patent application.

IV. DESCRIPTION OF THE PREFERRED EMBODIMENT

Figure 1:
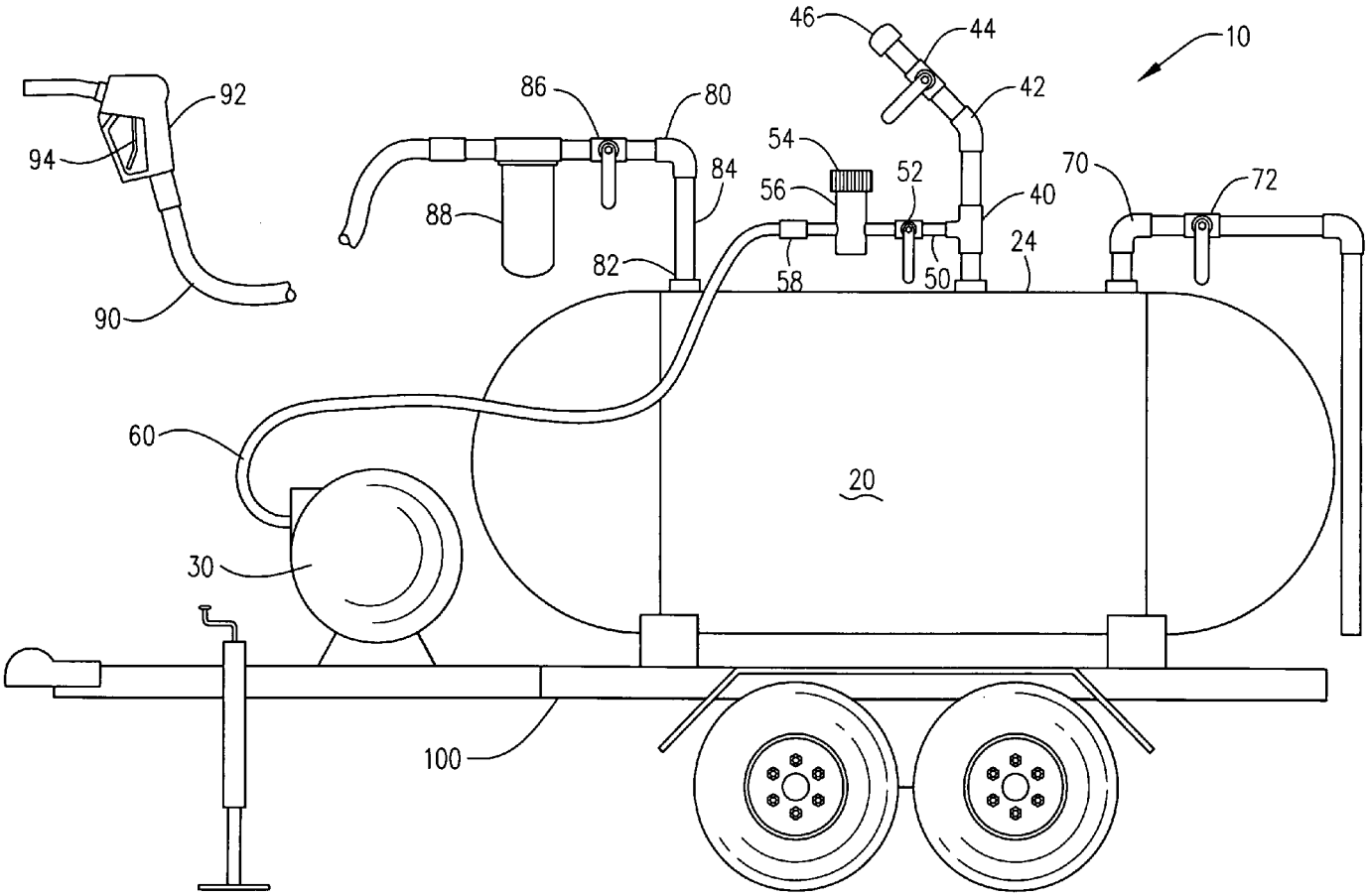
FIG. 1 is a side view of the fuel delivery system mounted upon a trailer bed.
Figure 2:
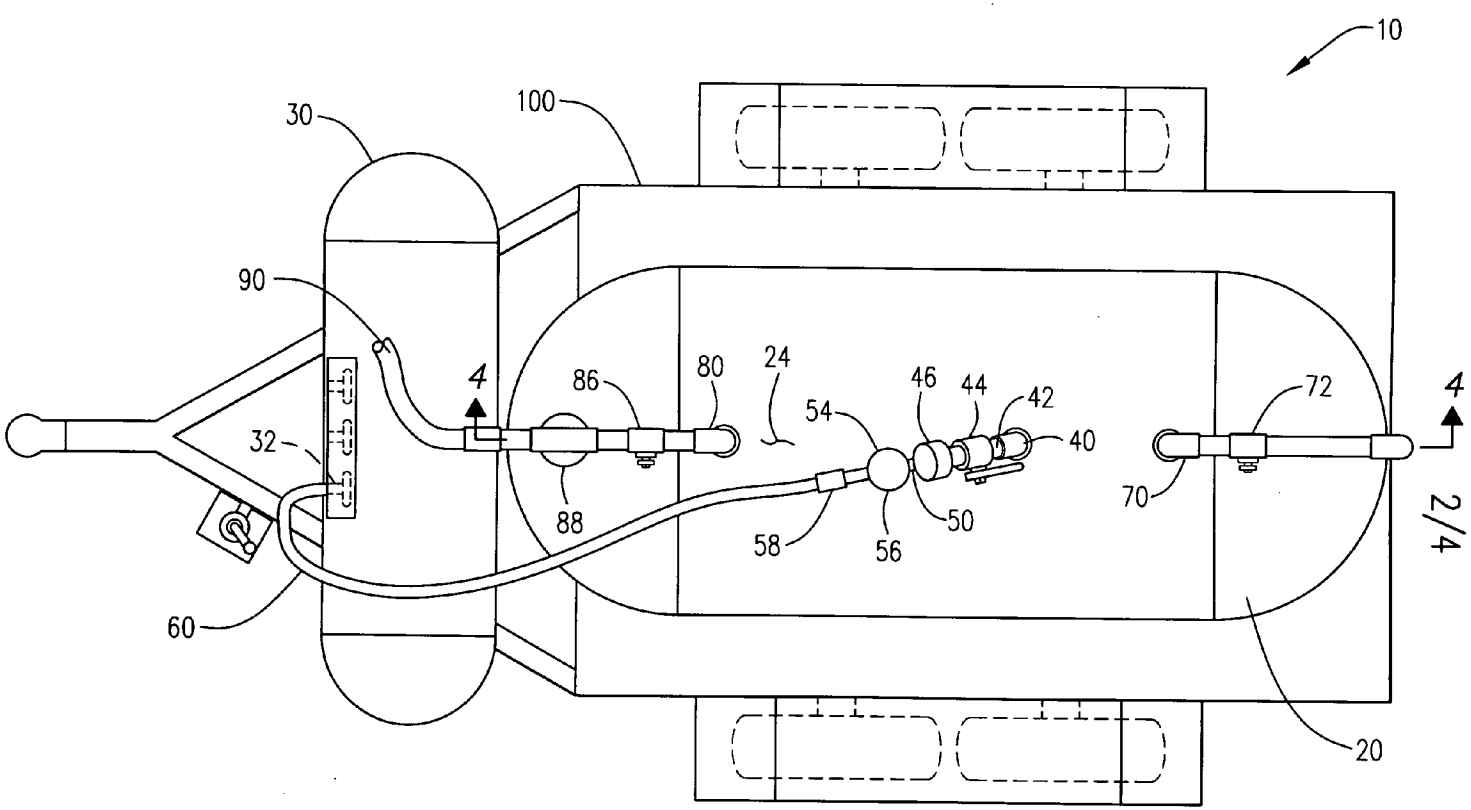
FIG. 2 is a top view of the fuel delivery system mounted upon a trailer.
Figure 3:
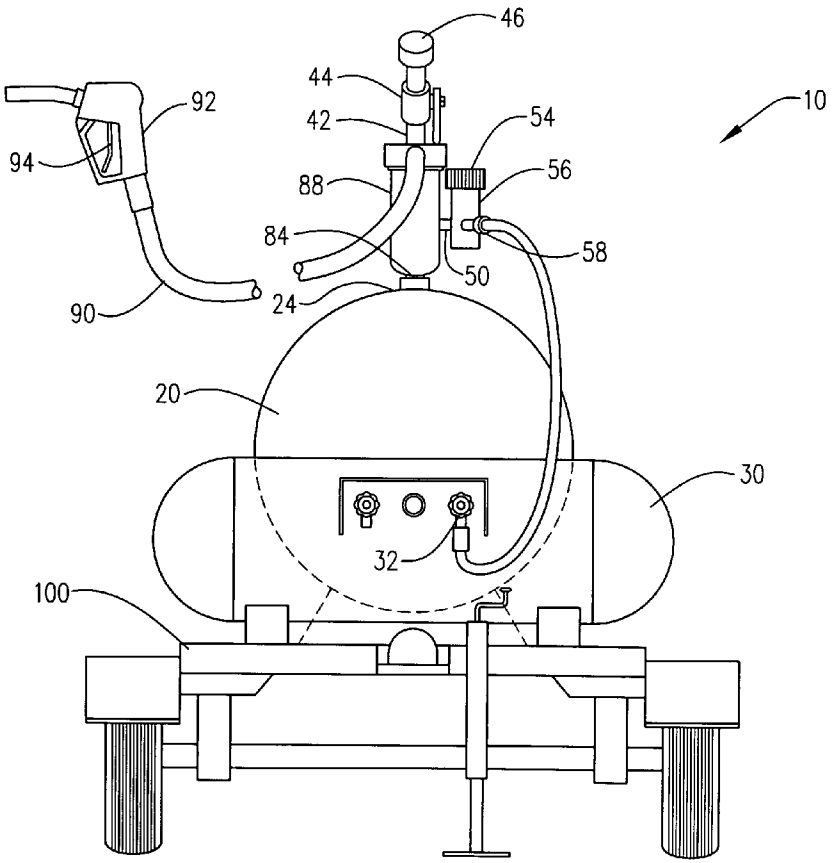
FIG. 3 is a rear view of the fuel delivery system mounted upon a trailer.
Figure 4:
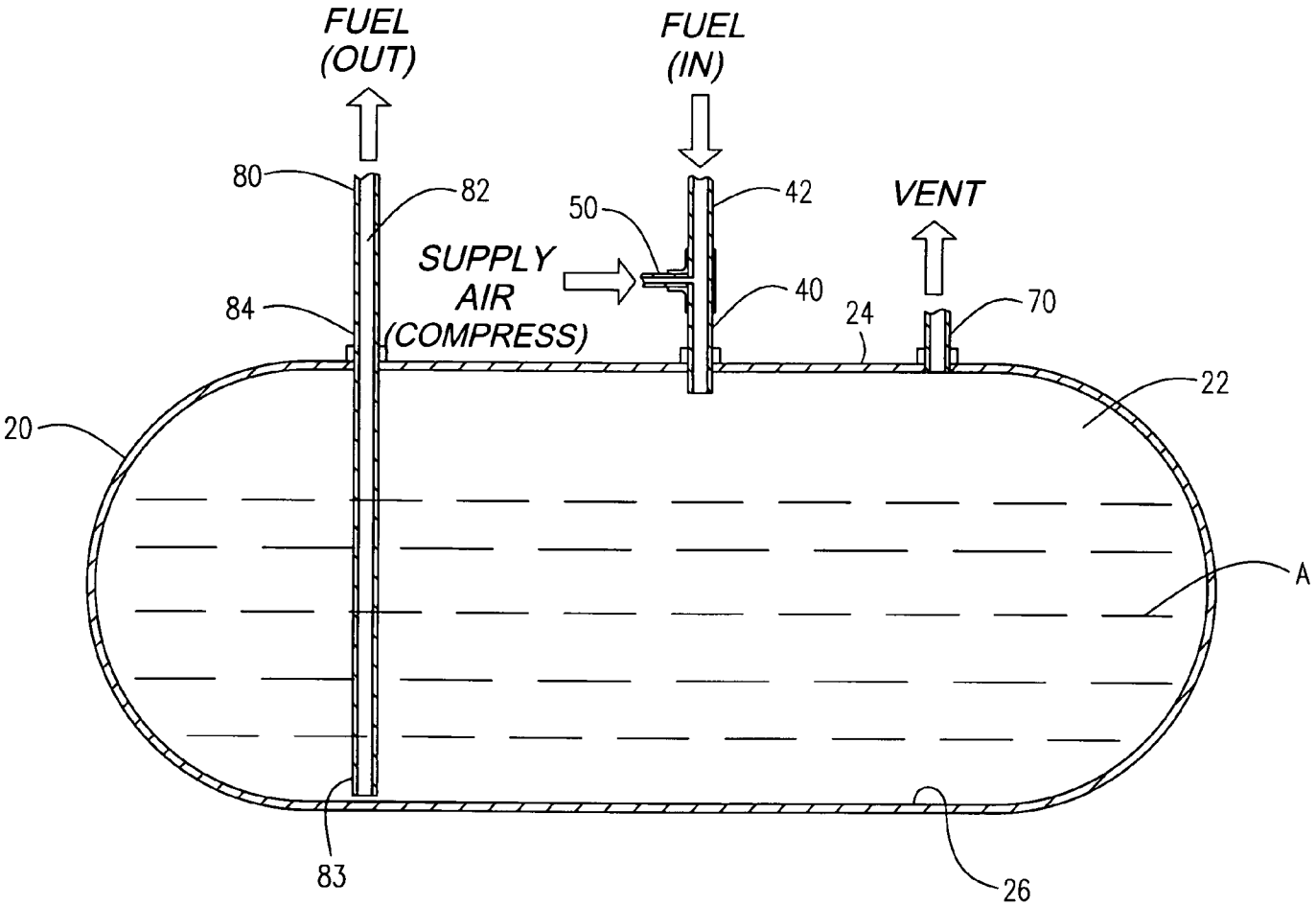
FIG. 4 is a side cross sectional view of the fuel tank indicating the various components which are connect to the fuel tank along section lines 4/4 of FIG. 2.

A pumpless, self-contained portable fuel delivery system 10 for the delivery of a liquid fuel A to remote locations and requiring no external or internal power supply in the delivery of the liquid fuel, as indicated in FIGS. 1-4 of the drawings, the fuel delivery system 10, installed within a vehicle or upon a trailer 100, comprising a liquid fuel container 20 having a pressure capacity of at least 200 psi and defining a large capacity cavity 22 containing a liquid fuel A, a large capacity air tank 30 having a pressure capacity of at least 200 psi, a first line 40 attached to a top portion 24 of the fuel container 20, the first line 40 entering the fuel container 20 and further providing a first extension 42 having a first ball valve 44 and extending an attaching cap 46 to access filling the cavity 22 of the fuel container 20 with a liquid fuel A and a second extension 50 containing a second ball valve 52, an air pressure regulator and pressure gauge 54 and extending an air check valve 56 with a quick coupling 58, an air hose 60 attached between a shutoff valve and pressure gauge 32 attached to the air tank 30 and the quick coupling 58 on the second extension 50, a second line 70 attached through the top portion 24 of the fuel container 20 containing a third ball valve 72 for ventilating the cavity 22 of the fuel container 20 when filling the fuel container 20 with liquid fuel, and a third line 80 providing a wet leg extension 82 attached through the top portion 24 of the fuel container 20, having a lower end 83 extending from a bottom portion 26 of the large capacity cavity 22 and an upper end 84 extending above the top portion 24 of the fuel container 20, the upper end 84 further attaching a fourth ball valve 86, an in-line liquid fuel filter 88 and further extending a flexible extraction hose 90 terminating a pump handle 92 with an automatic shutoff and manually depressed dispensing valve 94.

To fill the fuel container 20 with liquid fuel A, the third ball valve 72 is opened, providing a pathway through the second line 70 for air within the cavity 22 of the fuel container 20 to be evacuated during the introduction of the liquid fuel A into the cavity 22 thorough the first line 40 which has had a fuel supply line, not shown, connected to the first extension 42 after removal of the attaching cap 46, with the first ball valve 44 being opened and the second ball valve 52 closed. Upon completion of the filling of the fuel container 20, the third ball valve 72 would be closed, the first ball valve 44 would be closed and after the fuel supply line is removed, the attaching cap 46 would be applied.

Use of the fuel delivery system 10 would require the air tank 30 to be fully charge with compressed air or gas to a pressure of at least 200 psi and the fuel container 20 to be filled with a quantity of liquid fuel A. The first ball valve 44, second ball valve 52, the third ball valve 72 and the fourth ball valve 86 would be closed. The air hose 30 would be attached between the shutoff valve and pressure gauge 32 and the quick coupling 58 on the second extension 50, the shutoff valve 32 is then opened and the air pressure regulator and gauge 54 are set at a desired pressure, preferably at or near 30 psi, with the second ball valve 52 then opened to allow for the desired air pressure to be applied to the cavity 22 of the fuel container 20. When it is time to dispense liquid fuel A from the fuel delivery system 10, the fuel delivery system 10 is positioned near a vehicle or equipment to be filled, stabilized into a level position, with the fourth ball valve 86 being opened. The pump handle 92 is placed within the fuel tank opening of the vehicle or equipment, not shown, and upon depression of the dispensing valve 94, liquid fuel A is delivered from the cavity within the fuel container under pressure, through the third line 80 past the open fourth ball valve 86, though the flexible extraction hose 90 and out of the dispensing valve 94 into the fuel tank of the vehicle or equipment.

It has been demonstrated that the best mode for providing the fuel delivery system would include the use of all valves and line being made of 1½ inch metal pipe and composition, with the air hose 60 and air lines being provided as ⅜-½ inch lines. The air tank 30 would be provided as a 100 gallon air tank and filled to no less than 150 lbs of pressure with the air regulator set at 30 psi, and the fuel container 20 is a 500 gallon capacity vessel. Using this preferred dimension on the components, the fuel delivery system 10 has been demonstrated to be able to deliver 500 gallons of filtered liquid fuel at a rate of 40 gallons per minute. The minimum recommended operating pressure for the system is 30 psi or above.

The drawings illustrate the fuel delivery system 10 upon the bed of a trailer 100. While this has been shown to be an appropriate means of providing portability to the fuel deliver system 10, the fuel delivery system 10 may also be provided in the bed of a large capacity vehicle. The fuel delivery system may be provided as a independently operated vehicle for use in terminals or depots where fuel delivery is a constant and endless endeavor.

By providing the fuel delivery system 10 without any pumps, there are no pumps to fail or require service. Pumps have been known to fail in operation, become clogged with contaminants often found in the liquid fuel or from the environment within which the fuel delivery system is used, or from poor maintenance of the fuel delivery system. This provides an obvious improvement over fuel delivery systems that utilize pumps within a fuel delivery system. By providing the fuel delivery system 10 without the need for an internal or external power supply to dispense fuel, the fuel delivery system 10 may be used in any location without the need for a local power supply and without draining any power from the electronic battery supply on a vehicle use to provide portability to the fuel delivery system. Additionally without requiring any external or internal power supply requirements the fuel delivery system 10 is capable of a delayed use over long periods of time without the power supply being lost or discharged during the delay, providing the fuel delivery system 10 with a more reliable and dependable capability and a definitive advantage for use for its intended function than fuel delivery systems which require an internal or external power supply which may fail or become ineffective over a long delay between uses.

The fuel delivery system 10 uses simple compressed air or gas to delivery liquid fuel under pressure. It does not use a combustion gas, which generally contains combustion exhaust waste materials posing a fuel contamination issue, and also is delivered at an elevated temperature, which poses a safety hazard. Compressed air is preferred because it is cheap, safe and readily available at any location that has an air compressor, which would be found at any location where the fuel delivery system is most likely used, such as farms, industrial locations, depots, commercial facilities or at the same location where the fuel delivery system is filled with liquid fuel. By using compressed air as the simple and sole means of forcing the liquid fuel from the fuel container, a distinct advantage is obviously demonstrated over fuel delivery systems which require something more complicated to either force, urge or expel the liquid fuel from its container to a vehicle requiring refueling. It is contemplated within the scope of this fuel delivery system that in addition to compressed air, another inert gas or a compatible compressed combustion gas, including LP gas, natural gas, butane or other compressed gas that would not impair the liquid fuel combustion could be used in place of the compressed air.

The lower end 83 of the wet leg extension 82 should extend into the cavity 22 of the fuel container 20 within a half inch from the bottom portion 26 of the cavity 22 of the fuel container 20 to allow for the extraction of the majority of the liquid fuel content of the fuel container 20, but not extending completely to the bottom portion 26 of the cavity 22 to restrict the unimpeded flow of liquid fuel A into the bottom end 83 of the wet leg extension 82 or to cause restriction due to inevitable particulate materials found within the liquid fuel or introduced over time into the fuel container from the environment within which it is used.

While the fuel delivery system 10 has been particularly shown and described with reference to a preferred embodiment thereof, it will be understood by those skilled in the art that changes in form and detail may be made therein without departing from the spirit and scope of the intended fuel delivery system 10.

What is claimed is:

1. A pumpless, self-contained portable fuel delivery system for delivery of a liquid fuel at remote locations, installed within a vehicle or upon a trailer and requiring no external or internal power supply in the delivery of said liquid fuel, said fuel delivery system comprising:

a liquid fuel container having a pressure capacity of at least 200 psi and defining a large capacity cavity containing a liquid fuel;

a large capacity air tank having a pressure capacity of at least 200 psi and containing a quantity of compressed air or gas;

a first line attached to a top portion of said fuel container, said first line entering said fuel container and further providing a first extension having a first ball valve and extending with an attaching cap, said first extension used for filling said fuel container with a liquid fuel, and a second extension containing a second ball valve, an air pressure regulator and pressure gauge and extending an air check valve with a quick coupling for introducing said compressed air or gas into said fuel container;

an air hose attached between a shutoff valve and pressure gauge attached to said air tank and said quick coupling on said second extension;

a second line attached through said top portion of said fuel container containing a third ball valve for ventilating said fuel container during filling said fuel container with liquid fuel; and a third line providing a wet leg extension attached through said top portion of said fuel container, having a lower end extending from a location above said bottom portion of said large capacity cavity, said wet leg extension further extending an upper end above said top portion of said fuel container, said upper end further attaching a fourth ball valve, an in-line liquid fuel filter and further extending, a flexible extraction hose including a pump handle with an automatic shutoff and manually depressed dispensing valve, wherein said fuel delivery system contains no pumps which can clog or fail, contains no internal or external power supply for operation which may become exhausted, spent or otherwise fail, utilizing nothing more than cheap and affordable compressed pressurized air to operate said entire fuel delivery system.

2. The fuel delivery system as disclosed in claim 1, wherein said wet leg wet leg extension is extended into said fuel container to within a half inch from said bottom portion of said cavity of said fuel container, allowing for extraction of most of said liquid fuel within said fuel container, and without being fully extended to said bottom portion of said cavity which could result in a restriction to a flow of said liquid fuel from said bottom end of said wet leg extension or could cause a cessation of flow of said liquid fuel from said cavity due to a build-up of inevitably present particulate materials within said liquid fuel introduced into said cavity over time from an environment within which said fuel delivery system is used.

3. The fuel delivery system as disclosed in claim 1, wherein said first ball valve, second ball valve, third ball valve, said first line, second line and third line are all made with 1½ inch fittings and diameters and said air hose, air pressure regulator, pressure gauge, air check valve and quick coupling are provided as ⅜-½ inch lines and fittings.

4. The fuel delivery system as disclosed in claim 1, further comprising said air tank is at least 100 gallon capacity and filled to no less than 150 lbs of pressure with said air regulator set at 30 psi, and said fuel container is at least 500 gallon capacity.

5. The fuel delivery system as disclosed in claim 1, wherein said first ball valve, second ball valve, third ball valve, said first line, second line and third line are all made with 1½ inch fittings and diameters and said air hose, air pressure regulator, pressure gauge, air check valve and quick coupling are provided as ⅜-½ inch lines and fittings; and said air tank is at least 100 gallon capacity and filled to no less than 150 lbs of pressure with said air regulator set at 30 psi, and said fuel container is at least 500 gallon capacity, wherein said fuel delivery system is able to deliver 500 gallons of filtered fuel at a rate of 40 gallons per minute with a minimum operating pressure for the fuel delivery system at 30 psi or above.

* * * * *